US007410316B2

(12) United States Patent
Geserich

(10) Patent No.: US 7,410,316 B2
(45) Date of Patent: Aug. 12, 2008

(54) CASSETTE ACCEPTANCE DEVICE WITH STATE RECOGNITION FOR A PRINTING MAIL PROCESSING APPARATUS

(75) Inventor: Frank Geserich, Friedrichsthal (DE)

(73) Assignee: Francotyp-Postaliz GmbH (DE)

( * ) Notice: Subject to any disclaimer, the term of this patent is extended or adjusted under 35 U.S.C. 154(b) by 522 days.

(21) Appl. No.: 11/222,877

(22) Filed: Sep. 9, 2005

(65) Prior Publication Data

US 2006/0074818 A1 Apr. 6, 2006

(30) Foreign Application Priority Data

Oct. 1, 2004 (DE) ..... 20 2004 015 278 U

(51) Int. Cl.
*B41J 29/00* (2006.01)
*B41J 35/00* (2006.01)

(52) U.S. Cl. ..... 400/693; 400/208; 347/222

(58) Field of Classification Search ..... None
See application file for complete search history.

(56) References Cited

U.S. PATENT DOCUMENTS 6,380,965 B1 * 4/2002 Sims et al. ..... 347/218
6,811,337 B2 11/2004 Hetzer et al.
6,978,255 B1 12/2005 Pauschinger et al.
2003/0184642 A1 * 10/2003 Shibata et al. ..... 347/214
2003/0197770 A1 * 10/2003 Klinefelter et al. ..... 347/104
2006/0165461 A1 * 7/2006 Vandermeulen et al. ..... 400/208

FOREIGN PATENT DOCUMENTS

DE 199 58 941 A1 6/2001

* cited by examiner

*Primary Examiner*—Daniel J Colilla
(74) *Attorney, Agent, or Firm*—Schiff Hardin LLP

(57) ABSTRACT

A printing mail processing apparatus has an apparatus housing with a cassette bay therein, for removably receiving an exchangeable cassette. The cassette bay is closed by a cassette flap that has a finger on an underside thereof that interacts with a sensor. The sensor can detect, before exchange of a cassette that flap position for which a cassette extraction is possible. A microprocessor is connected to the sensor and uses the signal from the sensor to detect the position of the cassette flap. Given a closed cassette flap, the microprocessor causes voltage to be supplied to a chip reader unit mounted in the cassette bay. Given an opened cassette flap, the microprocessor causes voltage to be disconnected from the chip reader unit before each cassette exchange.

14 Claims, 7 Drawing Sheets

CASSETTE ACCEPTANCE DEVICE WITH STATE RECOGNITION FOR A PRINTING MAIL PROCESSING APPARATUS

BACKGROUND OF THE INVENTION

1. Field of the Invention

The present invention concerns a cassette acceptance device with the capability to recognize the state of the cover of the cassette opening or bay in a printing mail processing apparatus or a similar printing billing or mail processing apparatus.

2. Description of the Prior Art

Conventional thermotransfer franking machines of the type T1000 and Optimal commercially available from Francotyp Postalia & Co. KG do not have piracy protection for consumable material, i.e. an ink ribbon in a cassette. By means of an encoder, a microprocessor controller allows an ink ribbon conveyor to establish that an encoder disc is fastened on the same axle as a friction wheel, and the latter is likewise rotated. When the flap of the cassette bay is opened, a simple mechanism is activated and the friction wheel is raised from the ink ribbon of the cassette, which allows the cassette to be removed without causing damage. The operation of the machine is interrupted given a faulty ink ribbon transport.

The arrangement of a switch on the security housing of a franking machine is known from EP 1300807 A2; for different reasons, namely for protection for an operator so that if fingers of the operator are inserted into an opening of the franking machine, such as Ultimail®, also available from Francotyp Postalia & Co. KG, they are not crushed by the transverse movement of the printing carriage. This solution is only suitable for inkjet printing franking machines, particularly for exchange of ink cartridges via the opening that can be sealed by a flap. The flap is equipped with a stop that, upon opening of the flap, activates a switch inside the security housing, causing current supply to a motor of the transverse movement mechanism of the printing module to be interrupted. Adoption of this solution for thermotransfer franking machines with ink ribbon cassettes is not possible without difficulty since there no movement of the printing module nor an exchange of an ink cartridge. Moreover, recently mail carrier regulating authorities have begun to require a higher printing quality that is supported by piracy protection measures from the franking machine manufacturer (such as a chip applied on the consumable material).

DE 199 58 946 A1 discloses a thermotransfer franking machine with a microcomputer to which a contact or sensors is/are applied in order to indirectly establish the presence of exchanged consumable material based on a physical characteristic by means of an evaluation (implemented by the microprocessor) of measured sensor data and stored operating data. If a chip with identifying data is not arranged on the cassette, a chip card (provided for this purpose) must then be inserted into a slot of a chip card reader in order to read the identifying data. The exchange is thus permitted only some time later. Moreover, exactly where the sensors are arranged and which of these are used for evaluation is dependent on the franking machine type, because usually already-present sensors are used that do not specifically detect an exchange of consumable material.

A detector is known from DE 199 58 941 A1 that also reliably detects the removal or exchange of consumable material when the apparatus is deactivated and is not supplied with system voltage. For this purpose, the detector uses a typical lithium battery that supplies a memory with a memory-retention voltage. There is no discussion, however, as to exactly where the sensor is arranged relative to the cassette. According to one variant, piracy protection is possible for thermotransfer cassettes in the form of an electronically-programmable chip, but this presumes a precise alignment of the cassette with the chip relative to a reading unit (chip reader) and the application of a contact force on order to securely read the data. Given the use of a chip for the purpose of piracy protection, in operation an electrical voltage is applied across the chip. This document does not address preventing removal or circumvention of the cassette during the operating state, such that access to the activated reading unit is possible. Such an access would at least lead to operational interferences or to manipulation or even to destruction of the chip.

SUMMARY OF THE INVENTION

It is an object of the present invention to provide a cassette acceptance device for an ink ribbon cassette that is equipped with an electronically-programmable chip in order to provide a piracy protection, which can be used in a thermotransfer franking machine that is equipped to prevent the measures for piracy protection from being penetrated or attacked. A further object is to fashion a cassette bay in order to ensure the contacting of the chip during the operation. A correct alignment of the cassette relative to the chip reading unit and the application of a contact force on the chip contacts should ensue in an optimally simple and reliable manner. The shape of the cassette flap should contribute to the alignment of the cassette and state recognition of the flap position. It is a further object to design the protection against external access to the chip reading unit during the operating state in a manner that allows detection of the operating state in connection with the piracy protection.

The above object is achieved in accordance with the present invention by a cassette acceptance device for use with a printing mail processing apparatus having an apparatus housing with an exteriorly accessible cassette bay therein, closeable by a flap, the device including a sensor disposed to interact with a flap finger at an underside of the flap to detect, before exchange of a cassette with respect to the cassette bay, that flap position for which a cassette extraction is possible, and a microprocessor connected to the sensor that detects the position of the cassette flap dependent on the signal from the sensor. The microprocessor, given a closed cassette flap indicated by the sensor signal, causing voltage to be supplied to a chip reader unit mounted in the cassette bay and, given an open cassette flap indicated by the sensor signal, causing the voltage to be disconnected from the chip reader unit before each cassette exchange.

For a cassette bay that is sealed by a flap, in accordance with the invention the cassette acceptance mechanism has a sensor that can detect the flap position before the exchange in which a cassette removal is possible. After the exchange and closing of the flap, parameter, usage and operating data stored via the chip attached to the cassette are read in a known manner. A mechanism is provided in the area of the sensor carrier, this mechanism translating the opening of the cassette flap into a movement of a sensor activation element. A sensor carrier supports the sensor and is integrally molded on one of the sides of the shaped cassette bay part above this part. The mechanism is fastened on a chassis such that it can move opposite to an elastic force. A microprocessor is operationally connected with the sensor and detects the position of the cassette flap by means of the sensor and in cooperation with the mechanism. The microprocessor is programmed to enable voltage supply from the microprocessor to the chip reader unit only when the cassette flap is closed. Given a closed cassette flap, external access to the chip reader unit is not possible. By means of mechanical elements of the flap and/or the shape of the cassette bay part, the cassette is pressed into a position in which a locking element acts on an edge of the cassette by means of a pressure element so that a secure electrical contacting of the chip with the chip reader unit exists. By means of the arranged locking element, the cassette is brought into a precise position relative to the chip reader unit and a force sufficient for a secure electrical contacting is thereby applied. Moreover, mechanical guide elements for alignment of the cassette relative to the chip reader unit in connection with the application of a contact force are used in the cassette bay. On its underside, the cassette bay has at least one flap finger and at least one elevation that are disposed between both flap arms with support pins. The elevation is fashioned so that the cassette is forced into the closed flap position in the locking position. Upon opening of the cassette flap, external access to the chip reader unit is prevented until a sensor signal is switched via the activation element upon triggering of the sensor and the voltage supply of the chip reader unit is deactivated. Access to and extraction of the cassette are therefore possible only when the voltage supply of the chip reader unit has been deactivated.

DESCRIPTION OF THE PREFERRED EMBODIMENTS

Figure 1:
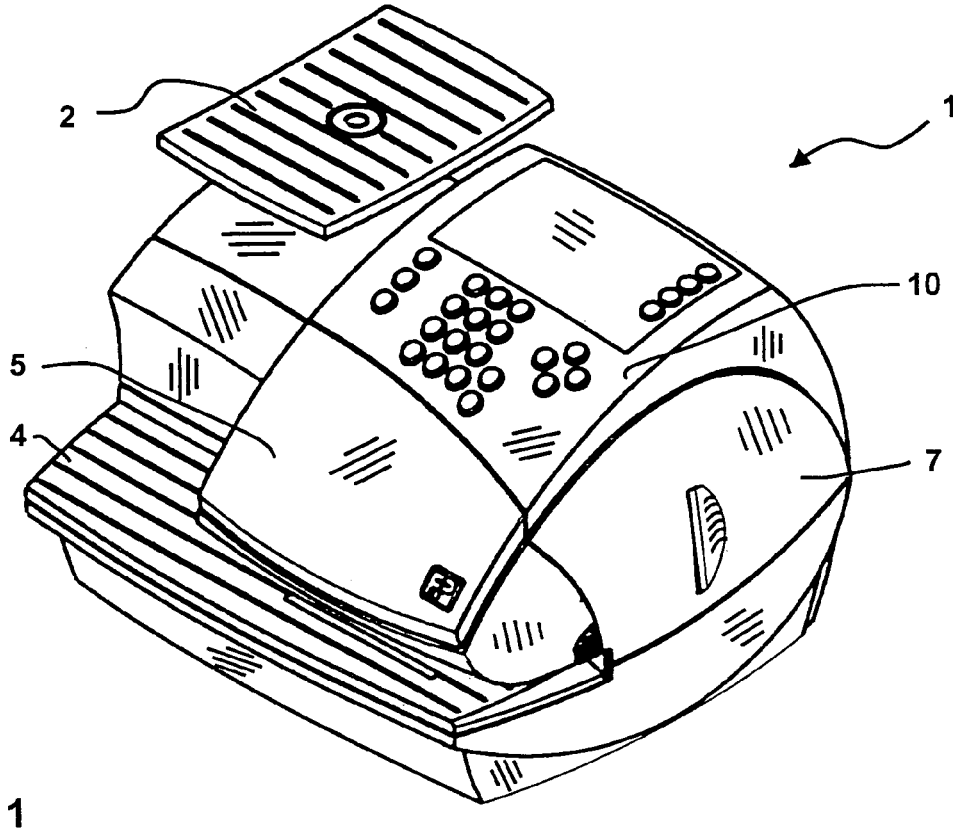
FIG. 1 is a perspective view of a thermotransfer franking machine with the flap of the cassette bay in place in accordance with the invention.

FIG. 1 shows a perspective view of a thermotransfer franking machine 1 from the front and upper right. The thermotransfer franking machine 1 is equipped on its right side 7 and on its upper part 10 with a flap 5 for the cassette bay of the franking machine 1, and on its left side with a weighing plate 2 of a scale component. All housing parts are manufactured, for example, from colored plastic. The transport of mail pieces to and from the franking machine 1 ensues on the feed table 4 of the franking machine on the front side of the franking machine 1, from the left side and to the right side 7.

Figure 2:
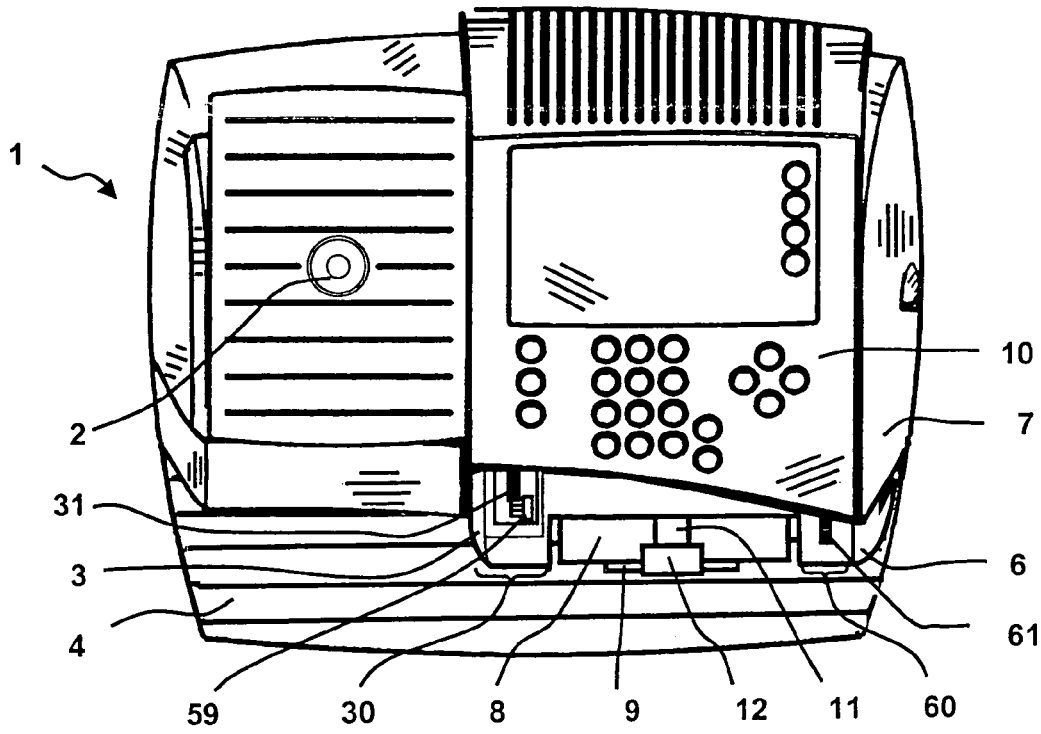
FIG. 2 is a plan view of the thermotransfer franking machine of FIG. 1 without the cassette flap in place.

FIG. 2 shows a plan view of a thermotransfer franking machine without the flap. The flap was removed on the front side of the upper part 10. Parts that are covered in FIG. 1 are thereby visible, such as: the left external housing wall 3 near the cassette bay on the left side near the weighing plate 2 and the covering 30 for a left-side cassette acceptance mechanism; the thermotransfer ink ribbon cassette 8 with a locking element 11 for precise positioning of the cassette 8 in a locked position, and with a pressure element 12 for the cassette 8 for applying a contact force; the thermotransfer print head 9; the covering 60 for a right-side mechanism of the cassette acceptance and the right external housing wall 6 near the cassette bay on the right side 7 of the franking machine. The left-side covering 30 and the right-side covering 60 respectively have slit-shaped openings 31 and 61 for the left and for the right flap arms of the flap 5 (not shown), respectively. A damping element 59 for braking the flap opening speed of the cassette flap is mounted on the cover 30 for the left-side of the cassette acceptance mechanism. External access to the chip reader unit is thereby prevented for a sufficiently-long time and the voltage supply of the chip reader unit can be deactivated in this time period. The aforementioned parts—except for the locking element 11 and the pressure element 12—are connected with the upper part 10 and belong to the upper housing shell. The feed table 4 belongs to the lower housing shell of the thermotransfer franking machine. Both the upper housing shell and the lower housing shell can be manufactured by injection molding.

Figure 3:
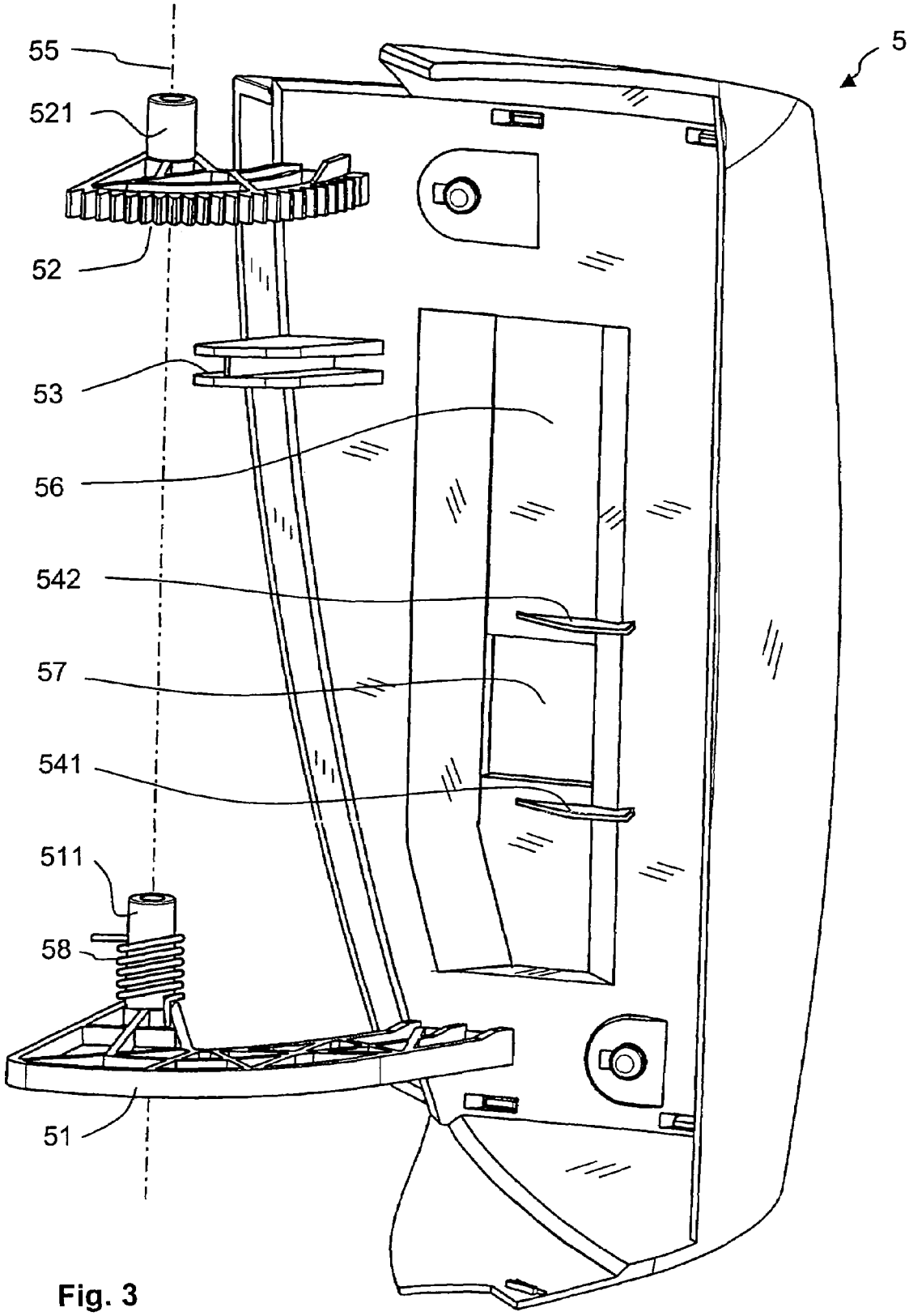
FIG. 3 is a view of the cassette flap from below.

FIG. 3 shows a view of the cassette flap 5 from below. In a depression 56, the cassette flap 5 has a cavity 57, corresponding to the size of the pressure element 12, which exerts a pressure force on the chip (not visible). A flap finger 53 and projections 541, 542 are arranged between the two flap arms 51 and 52. The left flap arm 52 is fashioned as a gearwheel segment in order to interact with the gearwheel of the damping element (not shown). Bearing pins 511, 521 for a connection (not shown, but rotatable on the axle 55) with the upper housing shell are respectively integrally molded on the flap arms 51 and 52. A spring 58 that produces a resilient and elastic force counter to the closing of the flap 5 is arranged at one of the bearing pins 511. The cassette flap 5 likewise can be manufactured by injection molding. In the event that the ink ribbon cassette 8 has not been correctly inserted by the operator, the projections 511, 542 on the underside of the cassette flap 5 force the ink ribbon cassette 8 into the locked position, at the latest upon closing of the cassette flap 5.

Figure 4:
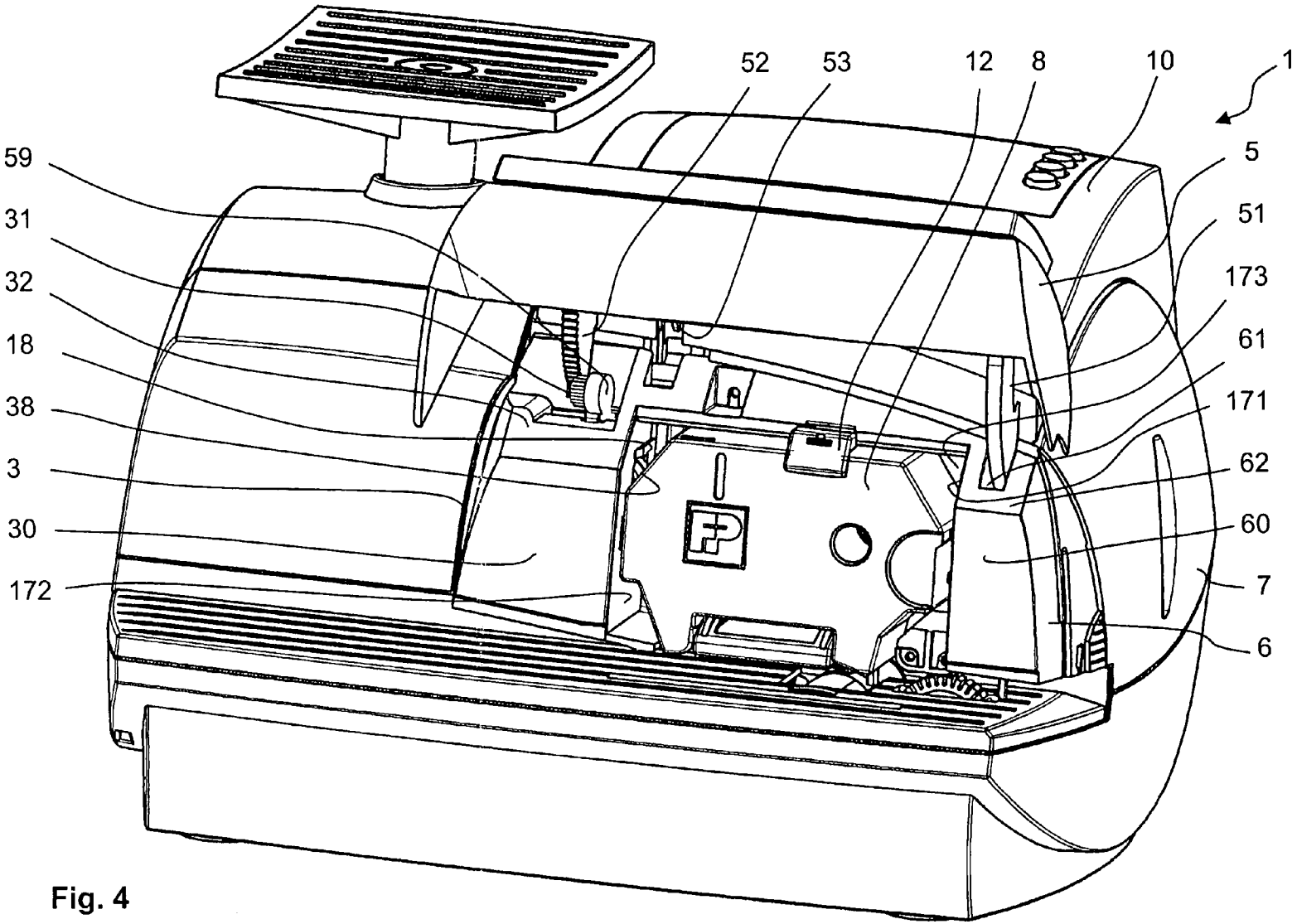
FIG. 4 is a perspective view of a thermotransfer franking machine of FIG. 1 with the cassette flap opened.

FIG. 4 shows a perspective view from the front and above right of a thermotransfer franking machine 1 with flap 5 opened. The flap 5 is shown opened in the direction toward the upper part 10. The flap 5 has flap arms 51, 52 arranged on both sides of its underside. The right external housing wall 6 on the cassette bay merges on the right side 7 into the right side wall of the upper shielding element of the franking machine, and into the right cover 60. A first step 62 (aligned as above) is provided that corresponds to the flap shape on its underside. The left external housing wall 3 on the cassette bay merges into the upper shell of the franking machine and into the left cover 30. A second step 32 (aligned as above) is provided that corresponds to the flap shape on its underside and accommodates the damping element 59 thereon. The damping element 59 is formed of a braking drum and a gearwheel that is engaged with the gearwheel segment of the left flap arm 52. Upon closing of the flap, the arms 51, 52 of the cassette flap 5 respectively dip into the corresponding slit-shaped openings 31 and 61 in the steps 32 and 62 of the left and right covers 30 and 60. On its underside, the flap 5 has a flap finger 53 serving as an activation element for a mechanism that acts on a sensor (not visible) that detects the state of the flap 5. A disconnection of the supply voltage already ensues upon lifting off the front flap edge by a few millimeters (approximately 10 to 20 mm travel), i.e. before an access to the chip reader unit or, respectively, the extraction of the cassette 8 is possible. A correctly-placed ink ribbon cassette 8 is precisely arranged by a locking element 11 resiliently mounted on the shaped cassette bay part 17. The ink ribbon cassette 8 is held in a locking position by the pressure element 12, the pressure element 12 being arranged at the tip of the locked element 11 (not visible) and a positive application of a sufficient contact force on the chip of the ink ribbon cassette 8 is effected.

A chip reader unit (covered) is arranged in an opening on the rear housing wall 173 of the cassette bay 17. The cassette bay is laterally bordered on both sides by a right inner housing wall 171 and a left inner housing wall 172. The left inner housing wall 172 has an opening 18 for the friction wheel 38, which is raised from the ink ribbon cassette in the representation according to FIG. 4, i.e. given an opened flap 5.

Figure 5A:
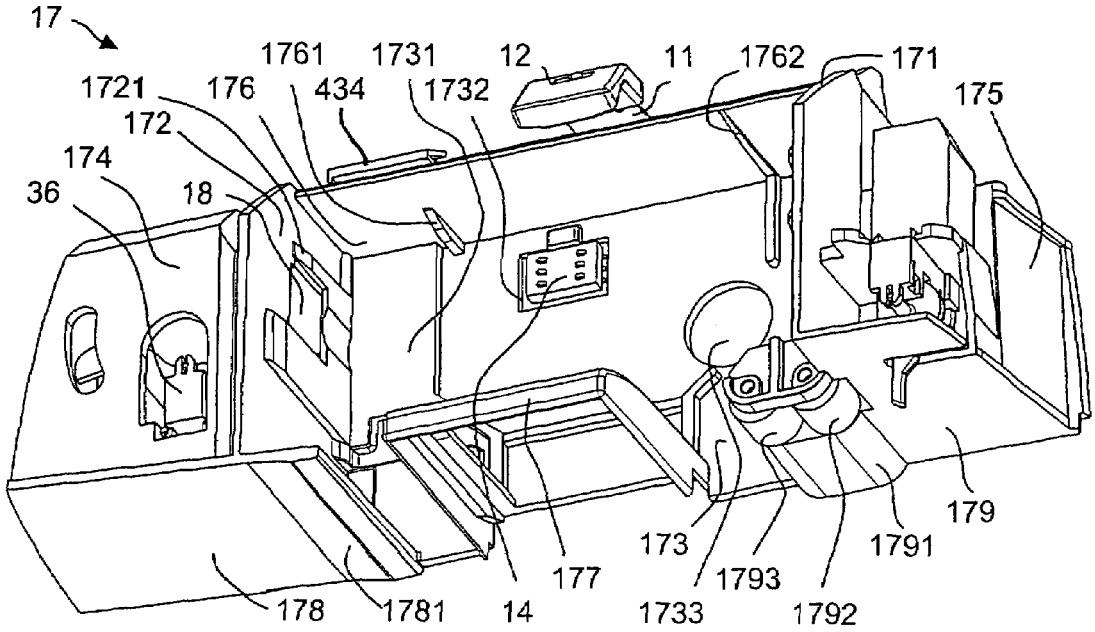
FIG. 5*a* is a perspective view of the shaped cassette bay part from the front and lower right in accordance with the invention.

FIG. 5*a* is a perspective view of the shaped cassette bay part from the front lower right. Respective mechanisms located under the cover and steps of the upper housing shell rest (in a manner not shown) on the chassis between the left and right inner housing walls 172 and 171 and the left and right outer housing walls on the shaped cassette bay part 17, while the associated sensors rest on respective integrally-molded sensor carriers 174 and 175. The sensor 36 for detection of the cassette flap state/encoder position rests on the external sensor carrier 174 of the shaped cassette bay part 17, the sensor carrier 174 being integrally-molded on the left inner housing wall 172. The inner space (cassette bay) of the shaped cassette bay part 17 is bordered by the right inner housing wall 171, the left inner housing wall 172 and the rear housing wall 173. A molding 1731 on the edge between the left inner housing wall 172 and the inside of the rear housing wall 173 forms an outer wall of a channel 1734 for a slider 43 (shown in other figures), of which only its top slope 434 is visible in FIG. 5*b*. A quadrilateral opening 1732 in the rear housing wall 173 accommodates the chip reader unit 14. A circular opening 1733 in the rear housing wall 173 is provided for the winding mandrel of the cassette coil (not shown). The left inner housing wall 172 has an opening 18 and a lateral guide 1721 for correct positioning of the cassette upon insertion. The right inner housing wall 171 likewise has a lateral guide. An upper housing wall 176 likewise has guides 1761, 1762 as positioning aids. The upper housing wall 176 laterally merges into the left and right inner housing wall and to the rear into the rear housing wall 173 and not only stabilizes the cassette bay but also carries integrally-molded fasteners (obscured in FIG. 5*b*) for the elastic locking element 11, on the free ends of which the pressure element 12 is integrally molded. A frame 177 (protruding into the inner space of the cassette bay) for the print head is integrally-molded on the lower end of the rear housing wall 173 in the middle thereof. The space enclosed by the lateral integrally-molded sensor carriers 174 and 175 is sealed from below by base plates 178, 179, which are respectively integrally-molded on the rear housing wall 173 between the left and right inner housing walls 172 and 171. For low-friction mail piece transport, it is advantageous for the base plate 178 to gently rise outwardly relative to the feed table 4. Downstream in terms of mail flow, the base plate 178 terminates in a thickened edge 1781 before the frame 177 for the print head. For ejection of the mail pieces, it is advantageous for the base plate 179 to begin with a thickening 1791 after the frame 177, the thickening 1791 accommodating non-actuated rollers 1792 and 1793 and supporting them such that they can rotate.

Figure 5B:
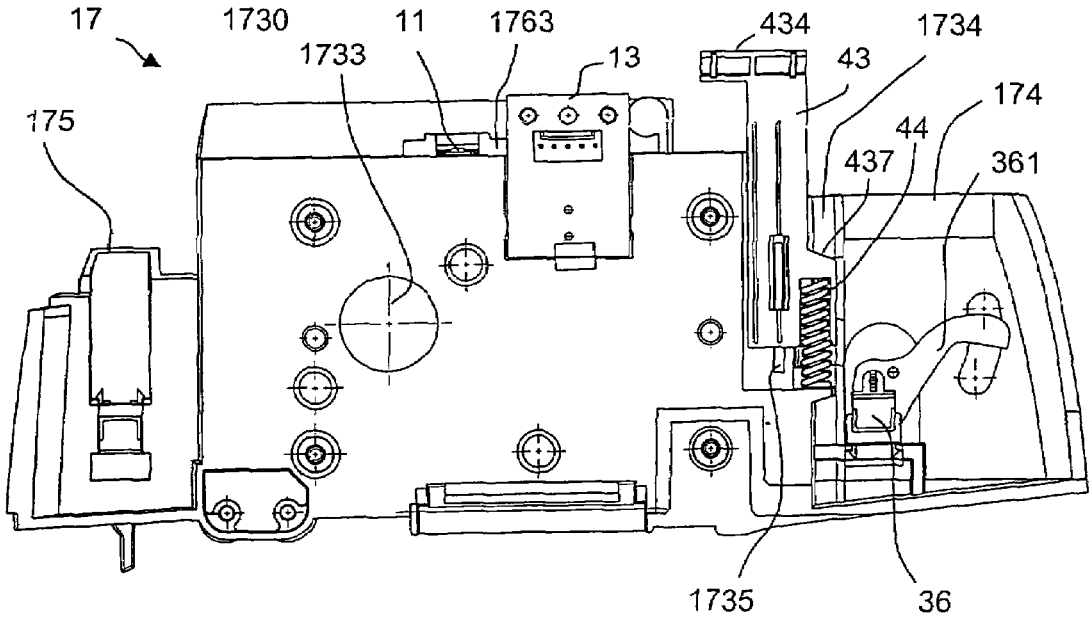
FIG. 5*b* is a rear view of the shaped cassette bay part in accordance with the invention.

FIG. 5*b* shows a rear view of the shaped cassette bay part with a channel-shaped molding 1734 on its outer wall 1730. The channel 1734 centrally has a guide channel 1734 for the rail 432 and a catch or dog 4331 on the front side of the slider 43. In the shown position, a force can be exerted by the pressure spring 44 on the mechanism (encoder wheel mounting, not shown) via the slider 43. The mechanism can move across the slider 43 by virtues of a first force $F_1$ acting on the slider 43. A pressure spring 44 is arranged on the slider 43 so that the pressure spring 44 relaxes and the first elastic force $F_1$ is effectively exerted on the mechanism when opening of the cassette flap 5 ensues. The slider 43 is movably arranged between the shaped cassette bay part 17 and the chassis in the channel 1734 of the shaped cassette bay part 17 and, in the representation according to FIG. 5*b*, is shifted upwardly. Upon activation the top slope 434 proceeds counter to the dynamic effect (force action) of the pressure spring 44. The slider 43 has an actuation slope 437 for the mechanism (located under the cover and steps of the upper housing shell) that is supported on the chassis. Operation thereof is initiated by a change of the cassette flap position (stable), detected by the sensor 36 that rests on the sensor carrier 174 of the shaped cassette bay part 17. The sensor carrier 174 is externally integrally-molded on the left inner housing wall 172 and has a sensor activation lever 361 that is brought into engagement with the mechanism. The other sensor carrier 175 of the shaped cassette bay part 17 likewise can have a sensor in order to detect the ejection of mail pieces. The back side 1730 of the rear housing wall 173 of the shaped cassette bay part 17 has a fastener 1763 for the locking element 11 resiliently mounted on the upper housing wall 176. The back side 1730 of the rear housing wall 173 of the shaped cassette bay part 17 shows the circular opening 1733 passing through it and a circuit board 13, which enables the electrical connection and mechanical fastening of the chip reading unit. The shaped cassette bay part 17 can be manufactured by injection-molding.

Figure 6:
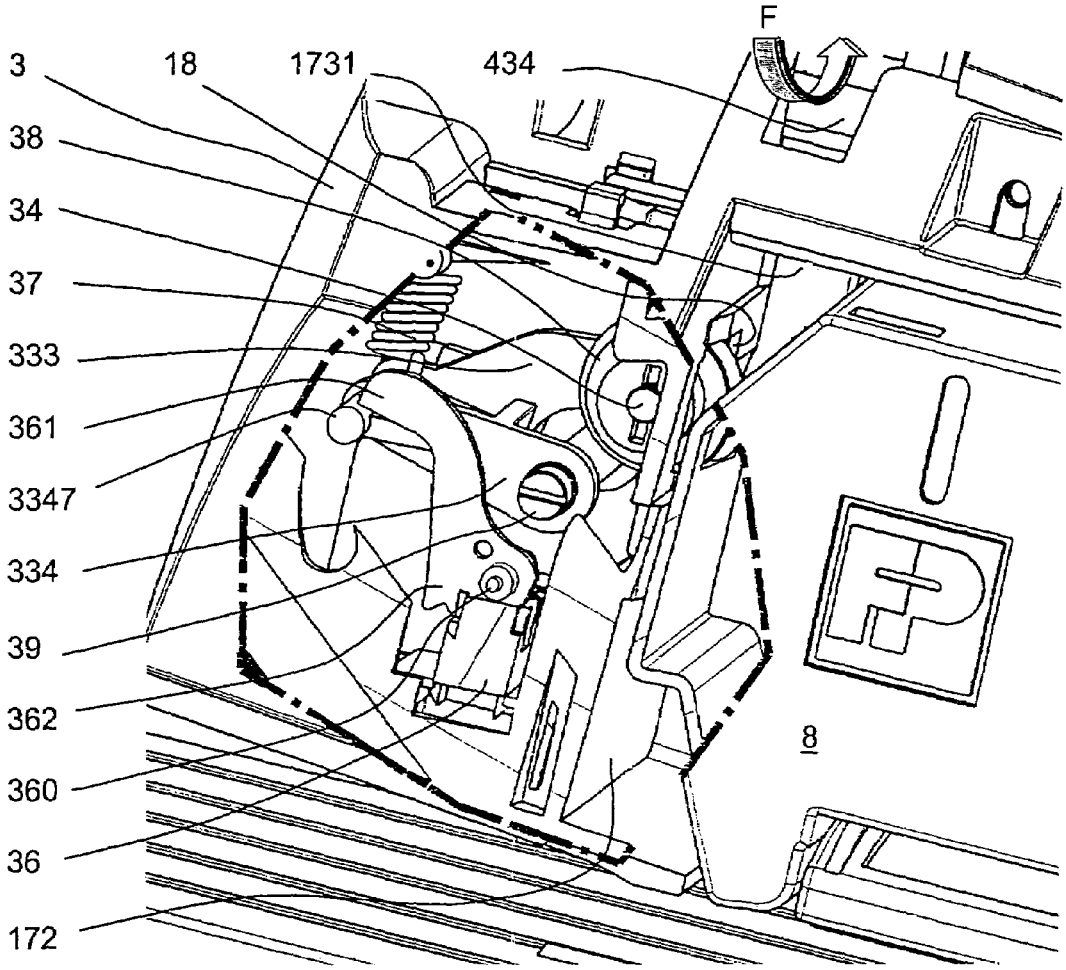
FIG. 6 is a detail of the mechanism to the left, next to the cassette bay in accordance with the invention.

FIG. 6 shows details of the mechanism that is arranged to the left, next to the cassette bay under the left cover 30. The mechanism has an encoder wheel mounting that is fastened on the chassis such that it can rotate around a rotation axle 39. The slider 43 is forcibly connected with the encoder wheel mounting, which can move counter to a second resilient force. Given an opened flap 5, the slider 43 between the chassis (not shown) and outer channel wall 1731 thus serves for force transfer to the encoder wheel mounting, which has a rocker 333 mounted such that it can rotate on the axle 39, the axle 39 being oriented transverse to the mail piece transport direction. Given a closed cassette flap (not shown), a force F is exerted on the top slope 434 of the slider 43 by the flap finger 53. The slider 43 is therefore shifted downwardly (as shown in the representation according to FIG. 6) and thus can exert no force on the encoder wheel mounting. A tension spring 37 is fastened on the shaped cassette bay part 17 near the left outer housing wall and engages the encoder wheel mounting 33 so that the tension spring 37 is tensed when the cassette flap 5 is opened, so a second resilient force $F_2$ is effectively exerted on the mechanism. The sensor actuation element itself has a spring and, in this exemplary embodiment, is formed as a sensor actuation lever 361 mounted such that it can resiliently rotate. Due to the force effect of the tension spring 37, a crank disk 3347 on the end of a fourth rocker 334 of the encoder wheel mounting is raised relative to the level of the feed table 4, thereby activating the sensor actuation lever 361. The sensor actuation lever 361 thereby performs a rotational movement around an axle 360, and a vane 362 integrally-molded on another end of the sensor actuation lever 361 projects from the detection region of the sensor electronic of the sensor electronic housing 363. At the same time, a friction wheel 38 is pushed through an opening 18 in the left inner housing wall 172 and through a lateral window opening of the ink ribbon cassette onto the ink ribbon. The friction wheel 38 is rigidly coupled with an encoder wheel (not shown) via a common bolt 34 supported in at least one rocker 333. When the ink ribbon is advanced (due to a printing event), this leads to a rotation movement that is transferred to the encoder wheel and is detected by an encoder (not shown).

Figure 7:
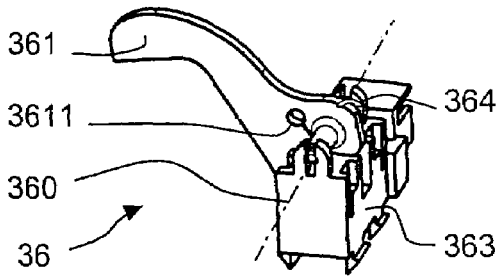
FIG. 7 shows sensor for detecting the cassette flap position or encoder position in accordance with the invention.

A sensor 36 for detection of the position of the cassette flap 5 (i.e., the encoder position) is shown in perspective view, from the front and upper right, in FIG. 7. A spring 364 holds the sensor actuation lever 361 in the shown position when it is not activated. This is the case when the cassette flap 5 is opened. The spring 364 is designed, for example, as a torsion spring with one spring leg situated in a hole 3611 of the sensor actuation lever 361 and the other spring leg resting on a sensor electronics housing 363. The sensor electronic 5 includes, for example, a light barrier that (in the shown position) is interrupted by the vane 362 integrally molded on the lever 361. For example, a sensor of the type Photointerrupter LG-413L from the company Kodenshi Corp. can be used. Given suitable dimensions of the encoder wheel mounting 33, the friction wheel 38 performs a sufficiently-large pivot movement that also actuates the sensor actuation lever 361, due to its lever length between its axle 360 and its outermost end.

Figure 8A:
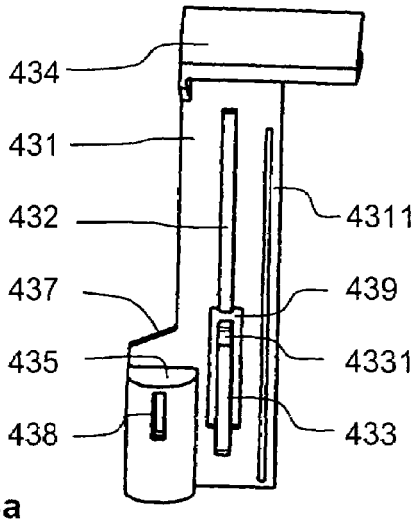
FIG. 8*a* is a front view of the slider shown in FIG. 5*b*.
Figures 8B, 9, 10, 11:
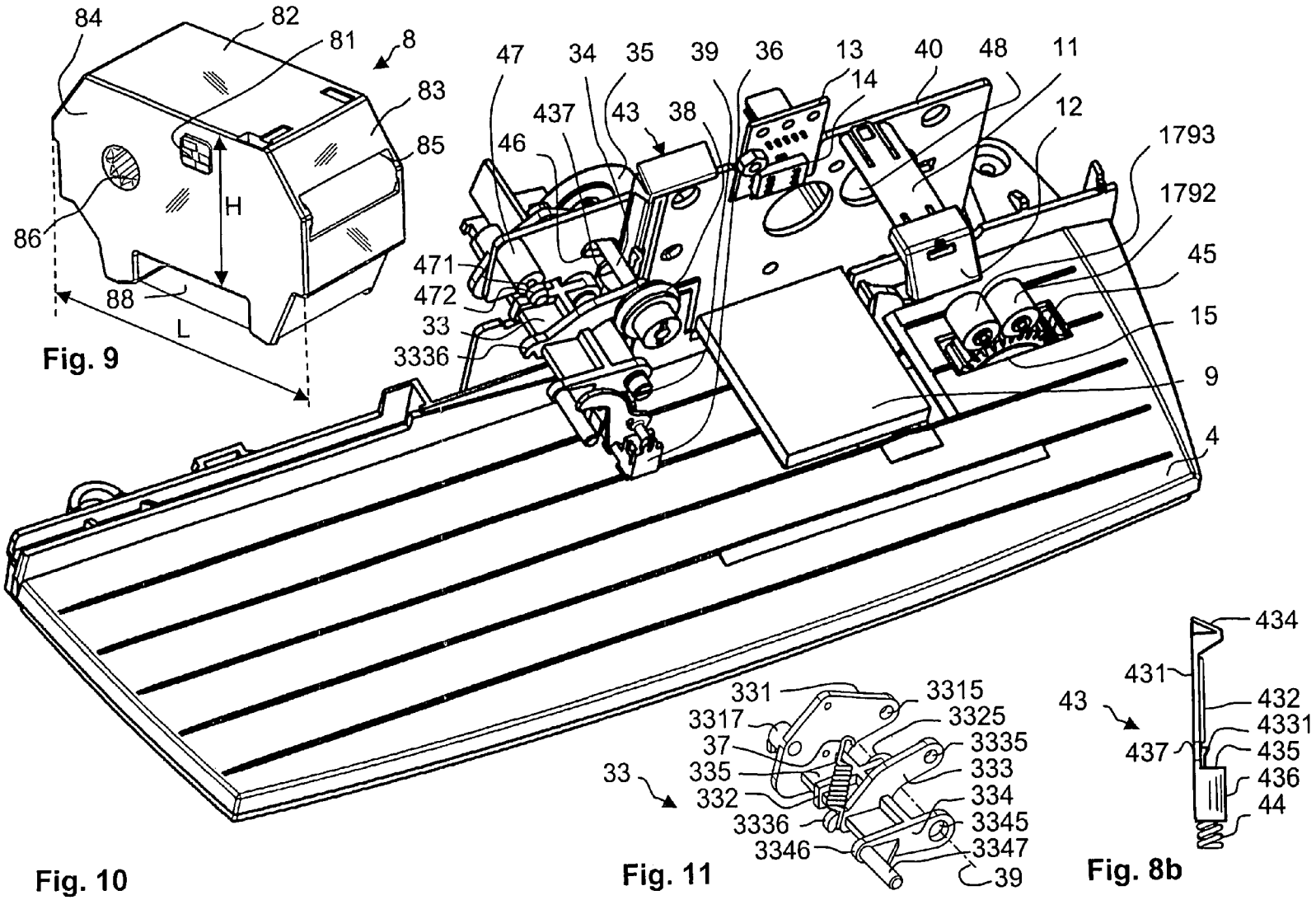
FIG. 8*b* is a side view of the slider shown in FIG. 5*b*.
FIG. 9 is a thermotransfer ink ribbon cassette with a chip in a perspective view from the rear and above left, suitable for use in the inventive thermotransfer franking machine in accordance with the invention.
FIG. 10 is a perspective view of the feed table and chassis of the thermotransfer franking machine in accordance with the invention.
FIG. 11 is a perspective view of the encoder wheel mounting in accordance with the invention.

A front view of the slider 43 is shown in FIG. 8*a* and a side view is shown in FIG. 8*b*. The slider 43 enables the pivot motion and, given opening of the flap 5, serves for force transfer to the encoder wheel mounting. A pressure spring 44 shifts the slider 43 upwardly with a predetermined force and thereby slides the axle 34 of the encoder wheel mounting 33 into an elongated (oblong or slotted) hole of the chassis 40, causing the encoder position to change to such a degree that the friction wheel 38 is no longer in contact with the cassette ink ribbon. Given an opened cassette flap 5, no force F is exerted on the top slope 434 of the slider planar body by the flap finger 53. The slider planar body 431 has a flat, smooth back side and at least one rail 432 for guidance to its front side, which is integrally molded running in the movement direction. A second, narrow guide rail 4311 can be integrally molded on the front side of the slider planar body 431. Its upper end is bordered by the top slope 434 and its lower end is bordered by a hollow cylinder that is integrally molded so as to curve forward. The wall 436 of the hollow cylinder has a fastening opening 438 for a pressure spring 44. Given an opened cassette flap 5, either a top 435 of the hollow cylinder or an actuation slope 437 of the slider planar body can come into engagement with at least one part of the mechanism located behind the left cover 30 of the upper housing shell. Between its middle and its lower end, the slider planar body 431 has a tuning fork-shaped opening 439 for a snap-in spring part 433 in the middle of the tuning fork-shaped opening 439. The snap-in spring part 433 is directed with its nose 4331 in the guide groove 1735 and prevents removal of the slider 43 from the channel in the mounted state (as is shown in FIG. 5*b*).

A thermotransfer ink ribbon cassette with chip is shown in FIG. 9 in perspective view from the rear upper left. The thermotransfer ink ribbon is visible in a lower first opening 88 and in a second opening 85 of the left side wall 83 of the housing of the thermotransfer ink ribbon cassette. The chip 81 (for example a conventional type SEL 4442 from Siemens AG) is centrally mounted near the upper edge of upper cassette wall 82 and the rear cassette wall 84. The latter has a height H=55 mm and a maximal length L=10.2 mm in the region of the lower first opening 88 up to the upper edge. A circular opening 86 is incorporated into the one half of the rear cassette wall 84 for a winding mandrel (not shown). The other half abuts the left side wall 83 of the housing.

A perspective view from the front left and above of the feed table and of the chassis of the franking machine is shown in FIG. 10. The perspective view also shows the relative position of mechanical and electrical components for the feed table 4 and for the chassis 40. These components (such as the locking element 11 with the pressure element 12, the circuit board 13 with the chip reader unit 14, the rollers 1792 and 1793 (participating in an un-actuated manner in the ejection), the sensor 36 and the slider 43) are all mounted on the shaped cassette bay part shown in FIGS. 5*a* and 5*b*. The position of the locking element 11 with the pressure element 12 relative to the thermotransfer print head 9 corresponds to the necessary separation resulting from the height H of the cassette 8. The thermotransfer print head 9 is fastened on the chassis 40 and protrudes into the mail transport path.

The slider 43 is arranged between the chassis 40 and the shaped cassette bay part, upstream (in terms of the mail flow) from the thermotransfer print head 9. A mechanism is arranged upstream (in terms of the mail flow) from the slider 43 and fastened on the chassis 40 such that it can rotate around a rotation axis 39. The mechanism has an oblong guide opening 46 introduced into the chassis 40 for the axle 34, for the encoder wheel 35 and the friction wheel 38, an encoder wheel mounting 33 that has a nose 3336 for fastening one end of a tension spring (not shown) and a separation element 47 that has a neck 471 with head 472 for fastening to the other end of the tension spring (not shown). The force effect of the tension spring (not shown) effects the support (shown in FIG. 10) of the axle 34 on one end in the oblong guide opening 46. The actuation slope 437 of the slider 43 abuts the axle 34 in order to be able to shift the bolt 34 into the oblong guide opening 46 when the cassette flap 5 is opened. The force effect of the pressure spring (not shown) of the slider is stronger than that of the tension spring and causes (in a manner not shown) the bolt 34 to be positioned at the other end in the oblong guide opening 46. The pressure spring is tensed upon closing of the cassette flap 5, in that its finger 53 presses on the top slope 434 (as has already been explained using FIG. 8*b*).

A circular opening 48 in the chassis 40 is provided for a winding mandrel (not shown) that is downstream (in terms of the mail flow) from the thermotransfer print head 9. At the outlet of the mail path, the feed table 4 exhibits a quadrilateral opening 45 that is provide for an actuated ejection roller 15 that faces the un-actuated rollers 1792, 1793 of the shaped cassette bay part, these un-actuated rollers 1792, 1793 also participating in the ejection of the mail pieces.

FIG. 11 shows a perspective view of an encoder wheel mounting from the front and upper left. The first and third rockers 331 and 33 of the encoder wheel mounting 33 exhibit bearing openings 3315 and 3335 for the axle 34 (not shown), via which the encoder wheel 35 (not shown) and the friction wheel 38 (not shown) are rigidly connected with one another. The second and fourth rocker 332 and 334 of the encoder wheel mounting 33 exhibit bearing openings 3325 and 3345 for the rotation axle 39 (shown in a dash-dot manner). One end of the tension spring 37 is connected with an end 3336 of the third rocker 333 of the encoder wheel mounting 33. A crank disk 3347 is arranged on the end 3346 of the third rocker 334 of the encoder wheel mounting 33 that is facing away from the rotation axle 39. The first and second rockers 331 and 332 are separated from one another via a connection piece 335. Connection pieces are likewise integrally molded between the other adjacent rockers. A nose 3317 is integrally molded on the first rocker 331.

Figure 13:
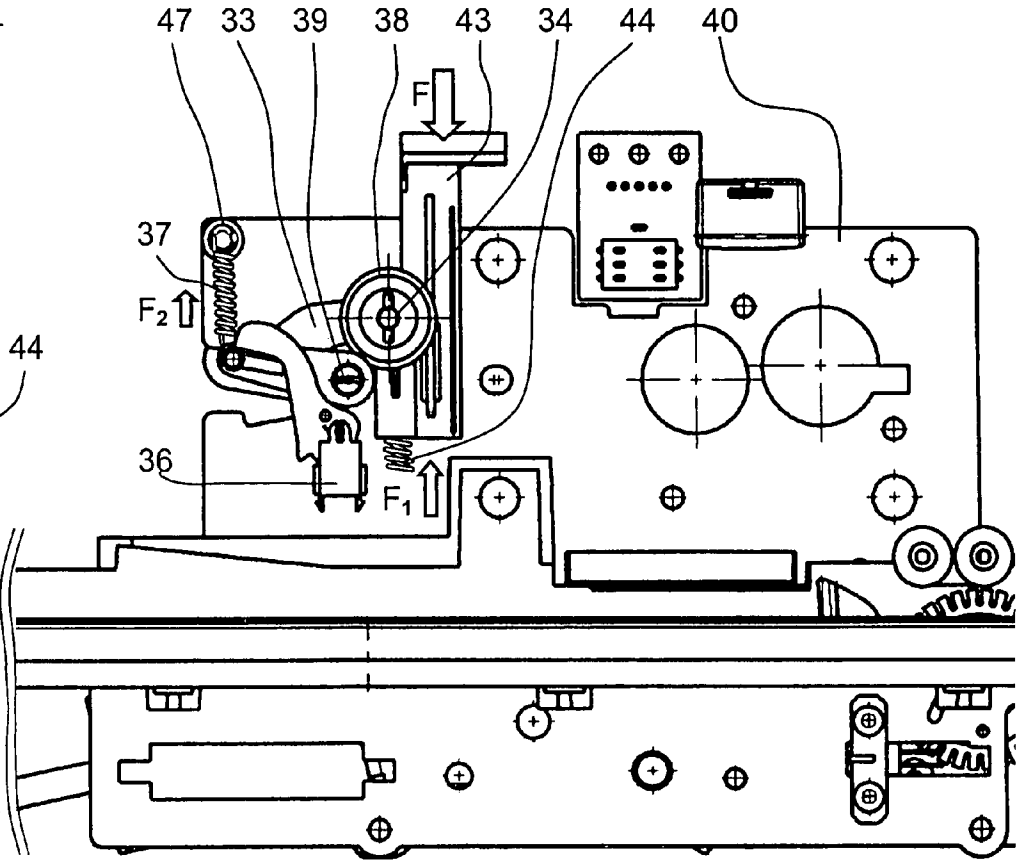
FIG. 13 is a front view of the feed table and chassis of the thermotransfer franking machine in accordance with the invention.
Figure 12:
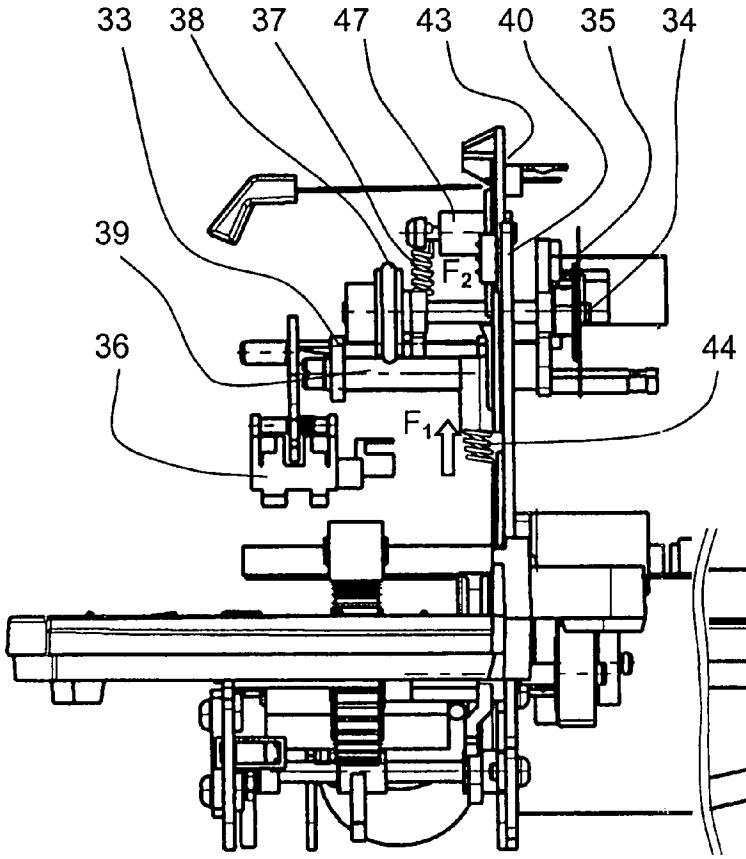
FIG. 12 is a side view of the feed table and chassis of the thermotransfer franking machine in accordance with the invention.

A side view of the feed table and chassis of the franking machine in the state of a closed (not shown) flap is shown in FIG. 12 and a front view is shown in FIG. 13. The inventive mechanism includes the separation element 47 fastened on the chassis 40, the oblong opening (not visible) introduced into the chassis 40 and the encoder wheel mounting 33 that can rotate around a rotation axle 39 fastened on the chassis 40. This encoder wheel mounting 33 actuates a sensor 36 and supports the axle 34 for the encoder wheel 35 and the friction wheel 38, whereby the position of the axle 34 is changed by the slider 43 due to the elastic force $F_1$ of a pressure spring 44 counter to the elastic force $F_2$ of a stressed tension spring 37 between the separation element 47 (fastened on the chassis 40) and the encoder wheel mounting 33 as soon as the flap is opened and the force effect F decreases. When a closing of the cassette flap 5 ensues, the pressure spring 44 is tensed since $F_2<F_1<F$. Via the opening 18, the friction wheel 38 of the shaped cassette bay part then arrives (in the manner shown in FIG. 5*a*) at engagement in the inserted cassette with its thermotransfer ink ribbon.

The axle 34, the rotation axle 39, the separation element 47 and the chassis 40 preferably are produced from metal, and the locking element 11, the tension spring 37, the pressure spring 44, the torsion spring 364 preferably are produced from spring steel. The torsion spring 364 exerts a third force effect $F_3$ on the crank disk 3347 of the spring-mounted encoder wheel mounting 33 via the sensor actuation lever 361, with $F_3<F_2$.

The encoder wheel mounting 33 can be manufactured from plastic or metal by injection-molding, but the invention is not limited to the shown preferred embodiment.

Alternatively, the encoder wheel mounting 33, the axle 34 and the axle 39 can exhibit a non-linear shape. For example, they can be curved from a wire segment like a paper clip. A hollow shaft attached on the wire segment instead of the axle 34 then bears the encoder wheel 35 and the friction wheel 38. The arrangement of the tension and/or pressure springs can be modified or omitted. The sensor actuation element is described above as a spring-supported, rotatable sensor actuation lever 361, but other embodiments are conceivable as long as they are able to detect a rotation movement. For example, a gearwheel engaged with a further gearwheel arranged on the rotation axle 39 can be arranged on the rotation axle 360 at the sensor 36. The torsion spring 364 can then be omitted. A further slider can serve as the sensor actuation element in a further embodiment variant.

Although modifications and changes may be suggested by those skilled in the art, it is the intention of the inventor to embody within the patent warranted hereon all changes and modifications as reasonably and properly come within the scope of his contribution to the art.

I claim as my invention:

1. In a printing mail processing apparatus having an apparatus housing with a cassette bay therein, adapted to removably receive an exchangeable cassette, and a chip reader unit mounted in the cassette bay, said chip reader unit being supplied with voltage from a voltage source in the apparatus, the improvement of a cassette acceptance device comprising:

an openable and closeable flap covering said cassette bay, said flap having an underside facing said cassette bay with a flap finger projecting therefrom;

a sensor disposed to interact with said flap finger to detect, and to generate a sensor signal, when said flap is in a position at which extraction of a cassette from the cassette bay is possible; and a microprocessor connected to said sensor, said microprocessor detecting a state of said cassette flap from said sensor signal and, when said flap is closed, causing voltage to be supplied from said voltage source to said chip reader unit, and when said flap is open, said microprocessor disconnecting said voltage source from said chip reader unit before said cassette is exchanged.

2. A cassette acceptance device as claimed in claim 1 comprising a mechanism in said cassette bay comprising a sensor actuation element, said mechanism converting opening of said cassette flap into a movement of said sensor actuation element;

a sensor carrier integrally molded at a side of said cassette bay that supports said carrier to interact with said sensor actuation element so that said movement of said sensor actuation element actuates said sensor and wherein said microprocessor is programmed to connect said voltage supply to said chip reader unit only when said cassette flap is closed.

3. A cassette acceptance device as claimed in claim 2 wherein said sensor actuation element comprises a resilient, rotatable lever.

4. A cassette acceptance device as claimed in claim 2 wherein said cassette bay has a left side and a right side, and wherein said sensor carrier is integrally molded at said left side of said cassette bay.

5. A cassette acceptance device as claimed in claim 2 comprising a chassis on which said mechanism is fastened, allowing said mechanism to move counter to a resilient force.

6. A cassette acceptance device as claimed in claim 5 comprising a slider in said cassette bay interacting with said mechanism, said mechanism being movable by said slider in response to a further resilient force acting on said slider.

7. A cassette acceptance device as claimed in claim 6 comprising a compression spring attached to said slider, said compression spring being decompressed to exert said further elastic force on said mechanism when said cassette flap is opened.

8. A cassette acceptance device as claimed in claim 7 comprising a shaped cassette bay part, forming a portion of said cassette bay, said shaped cassette bay part having a channel therein and said slider being disposed between said shaped cassette bay part and said chassis for movement in said channel.

9. A cassette acceptance device as claimed in claim 8 wherein said mechanism comprises an encoder wheel mounting fastened on said chassis for rotation on a rotation axle, said slider being in force-transmitting engagement with said encoder wheel mounting and said encoder wheel mounting being movable counter to said resilient force.

10. A cassette acceptance device as claimed in claim 9 wherein said slider comprises an actuation slope and wherein said encoder wheel mounting comprises an encoder wheel mounted for rotation on an encoder wheel axle, said encoder wheel axle engaging said actuation slope to move said encoder wheel mounting counter to said resilient force.

11. A cassette acceptance device as claimed in claim 10 comprising a tension spring connected to said encoder wheel mounting, said tension spring being extended upon opening of said cassette flap to produce said resilient force that acts on said mechanism.

12. A cassette acceptance device as claimed in claim 11 comprising a friction wheel also rotatable on said encoder wheel rotation axle, and wherein said shaped cassette bay part comprises an opening through which said friction wheel is caused to protrude by said compression spring when said cassette flap is closed, said friction wheel being adapted to engage a thermotransfer ink ribbon of said cassette when said cassette is received in said cassette bay.

13. A cassette acceptance device as claimed in claim 1 wherein said cassette has a chip disposed thereon, and wherein said cassette acceptable device comprises a shaped cassette bay part forming a portion of said cassette bay, mechanical elements disposed on said cassette flap and on said shaped cassette bay part, and a locking element disposed at a side of said cassette bay and being biased by a pressure element, said mechanical elements being adapted to interact with a cassette upon insertion of the cassette in said cassette bay to push said cassette into a position causing said locking element to act on an edge of said cassette to produce a positive electrical contacting of said chip with said chip reader unit.

14. A cassette acceptance device as claimed in claim 13 wherein said cassette flap comprises flap arms having supporting pins that mount said flap arms to said apparatus housing allowing pivoting of said cassette flap to open and close said cassette flap, and wherein said mechanical elements comprise at least one projection on said flap disposed between said flap arms, said projection being adapted to force said cassette into a locking position in contact with said locking element when said cassette flap is closed.

* * * * *